US008656539B1

(12) United States Patent
Boyd

(10) Patent No.: US 8,656,539 B1
(45) Date of Patent: Feb. 25, 2014

(54) MULTI-CHAMBER AIR MATTRESS WITH PERIPHERAL CHAMBER

(76) Inventor: Dennis Boyd, St. Louis, MO (US)

( * ) Notice: Subject to any disclaimer, the term of this patent is extended or adjusted under 35 U.S.C. 154(b) by 113 days.

(21) Appl. No.: 12/861,607

(22) Filed: Aug. 23, 2010

(51) Int. Cl.
*A47C 27/10* (2006.01)

(52) U.S. Cl.
USPC ..... 5/710; 5/711; 5/712; 5/713; 5/655.3

(58) Field of Classification Search
USPC ..... 5/706, 707, 710–714, 655.3
See application file for complete search history.

(56) References Cited

U.S. PATENT DOCUMENTS 274,495 A * 3/1883 Heath ..... 5/706
2,614,272 A * 10/1952 Morner ..... 5/655.3
5,561,873 A * 10/1996 Weedling ..... 5/713
7,376,995 B2 * 5/2008 Davis ..... 5/710
7,627,910 B2 * 12/2009 Davis ..... 5/81.1 R
2002/0184711 A1 * 12/2002 Mahoney et al. ..... 5/713
2005/0204475 A1 * 9/2005 Schmitz et al. ..... 5/710
2007/0277325 A1 * 12/2007 Bertram et al. ..... 5/713
2008/0289102 A1 * 11/2008 Davis ..... 5/81.1 R
2009/0165211 A1 * 7/2009 Song et al. ..... 5/706

* cited by examiner

*Primary Examiner* — William Kelleher
(74) *Attorney, Agent, or Firm* — Husch Blackwell LLP; H. Frederick Rusche

(57) ABSTRACT

An air mattress system includes two contiguous inflatable air chambers arranged side by side and operatively connected to form an air mattress and a peripheral air chamber operatively connected to and arranged around the perimeter of the two contiguous inflatable air chambers. An air pump is connected with each of the air chambers, and a control is provided for controlling the operation of the air pump.

29 Claims, 4 Drawing Sheets

MULTI-CHAMBER AIR MATTRESS WITH PERIPHERAL CHAMBER

TECHNICAL FIELD OF THE INVENTION

The present invention relates generally to the field of air mattresses and, more particularly, to an improved air mattress system with multiple air chambers, including a peripheral air chamber.

BACKGROUND OF THE INVENTION

Air beds having multiple, independently inflatable chambers for multiple users are known but suffer from significant drawbacks. Among these drawbacks are peripheral edges that tend to be less supportive and to compress easily as a weight, for example the body of the mattress user, moves closer to the mattress edge. The collapsing edge creates many significant issues for users. It makes it more difficult for users to get on and off of the mattress. It can also make it more likely for a user to unintentionally roll off of the mattress during sleep.

Therefore, it would be advantageous to provide an air mattress with a structure that minimizes or eliminates edge sagging in order to address one or more of the problems set forth above.

SUMMARY OF THE INVENTION

One aspect of the invention generally pertains to an air mattress system with improved comfort and structural integrity.

Another aspect of the invention pertains to an air mattress system that reduces or eliminates edge sagging of multi-chamber air mattresses.

In accordance with one or more of the above aspects of the invention, there is provided an air mattress system that includes two contiguous inflatable air chambers arranged side by side and operatively connected to form an air mattress with a peripheral air chamber operatively connected to and arranged around the perimeter of the two contiguous inflatable air chambers. An air pump is connected with each of the air chambers, and a control is provided for controlling the operation of the air pump.

These aspects are merely illustrative of the innumerable aspects associated with the present invention and should not be deemed as limiting in any manner. These and other aspects, features and advantages of the present invention will become apparent from the following detailed description when taken in conjunction with the referenced drawings.

BRIEF DESCRIPTION OF THE DRAWINGS

Reference is now made more particularly to the drawings, which illustrate the best presently known mode of carrying out the invention and wherein similar, reference characters indicate the same parts throughout the views.

DETAILED DESCRIPTION

In the following detailed description numerous specific details are set forth in order to provide a thorough understanding of the invention. However, it will be understood by those skilled in the art that the present invention may be practiced without these specific details. For example, the invention is not limited in scope to the particular type of industry application depicted in the figures. In other instances, well-known methods, procedures, and components have not been described in detail so as not to obscure the present invention.

Figure 1:
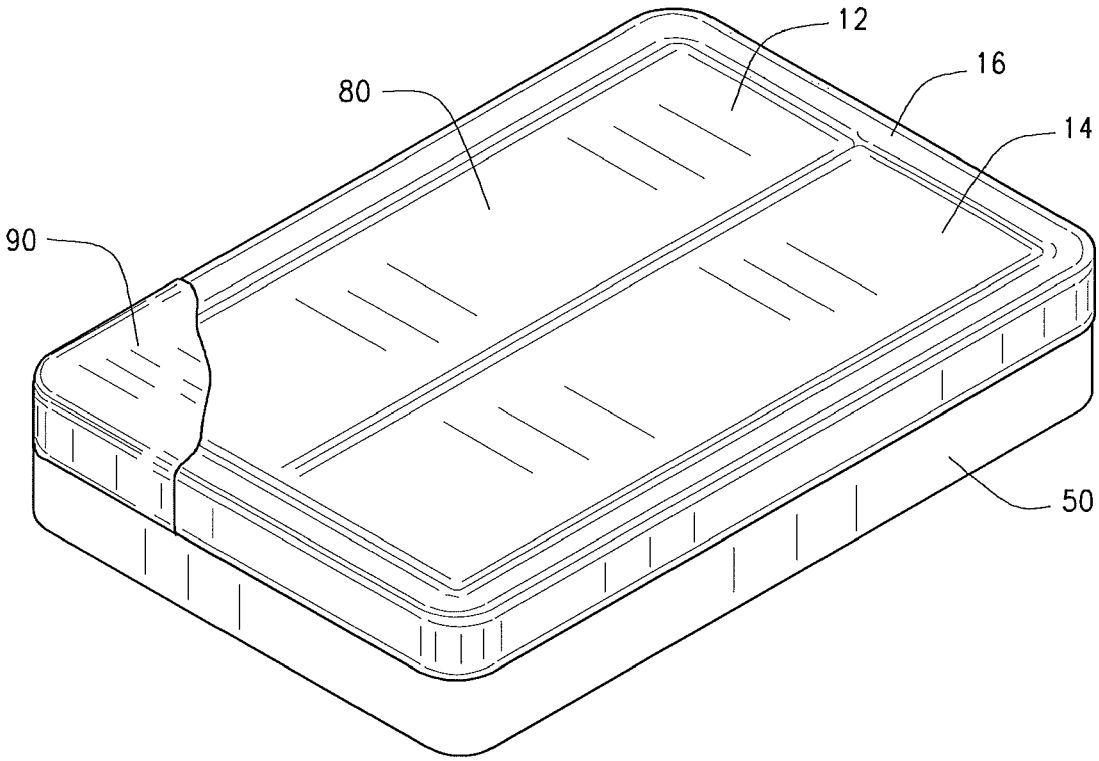
FIG. 1 is a simplified perspective view of an air mattress system according to an embodiment of the present invention.
Figure 2:
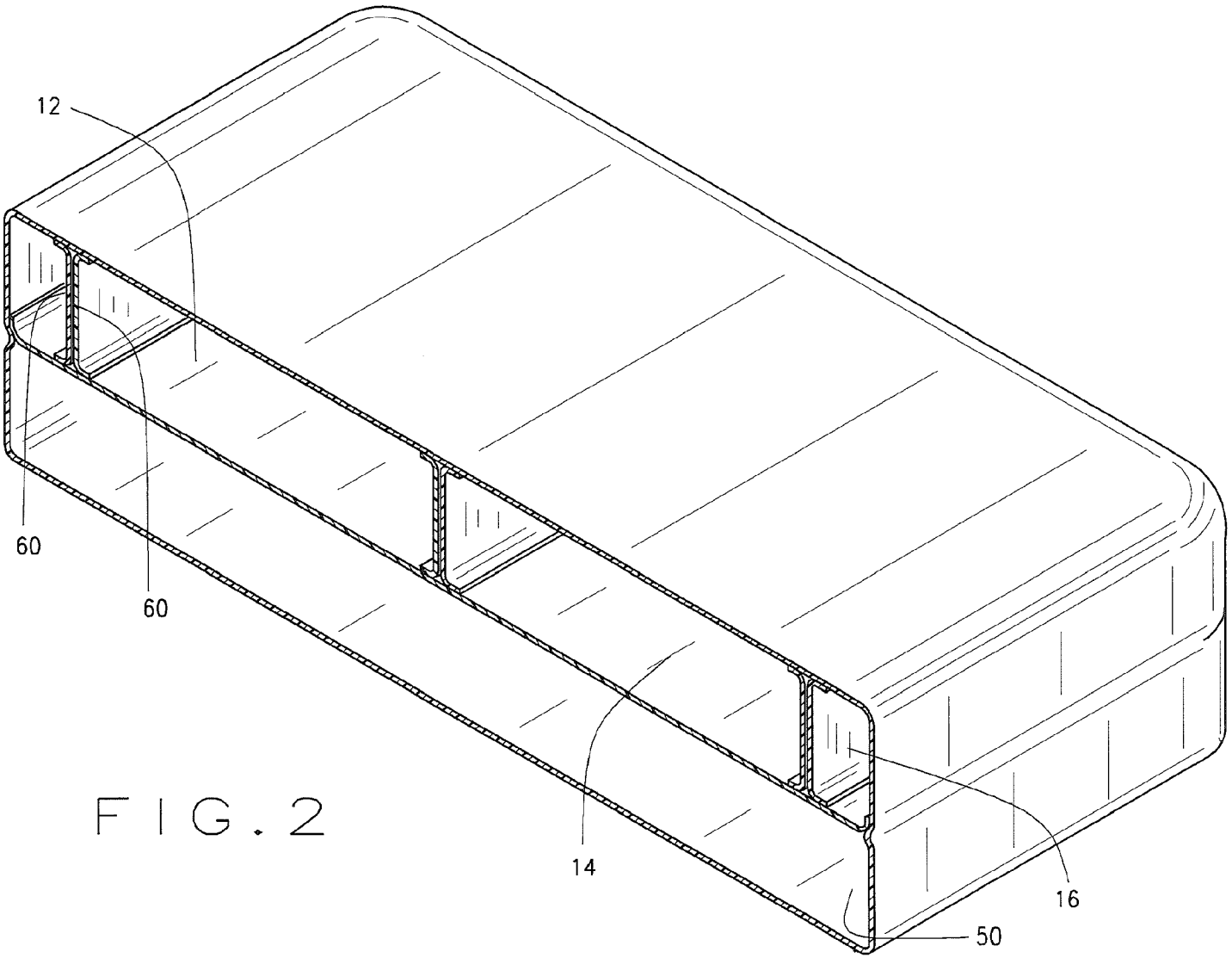
FIG. 2 is an enlarged cutaway view of the air mattress of FIG. 1.
Figure 3:
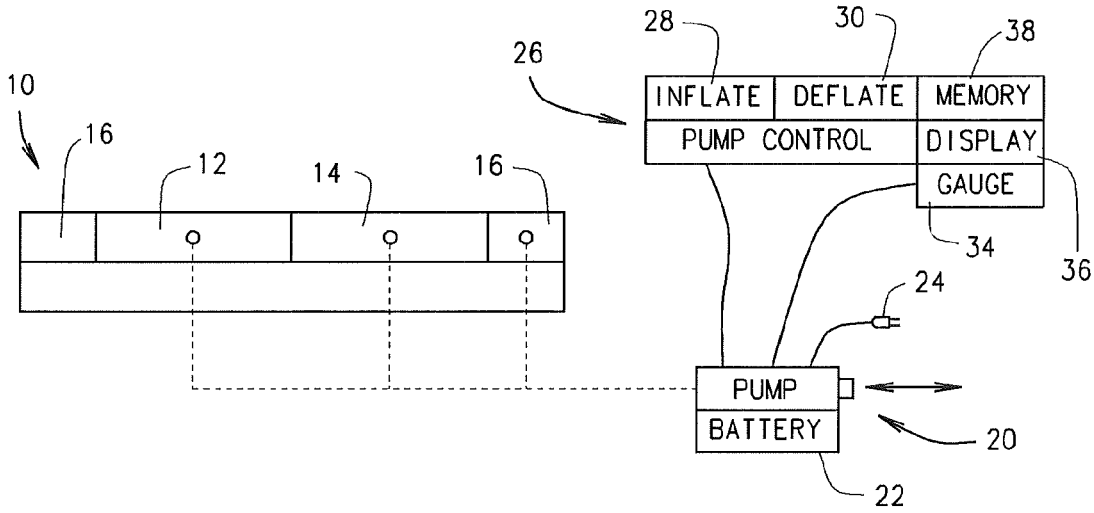
FIG. 3 is a block diagrammatic view of an air mattress system according to an embodiment of the present invention.

An air mattress system 10 according to a first embodiment of the present invention is illustrated in FIGS. 1-3 and includes at least three inflatable air chambers 12, 14, 16 operatively connected to form an air mattress. The air chambers are preferably contiguous and are operatively connected in such a manner that each air chamber includes a standard valve 18 for permitting inflation and deflation of each chamber. Preferably the chambers are inflated and deflated using a reversible air pump 20 operatively connected to the air chambers, as indicated by the dashed lines in FIG. 3. The air pump 20 is reversible, as indicated by the double-headed arrow to the right of the inlet port of the pump, so that it may be used to both inflate and deflate the air chambers. As shown in FIG. 3, pump 20 is preferably an electric pump powered either by a battery 22 or conventional AC power (indicated by electrical cord 24). Pump 20 may be positioned within a "pocket" in the air mattress 10 to avoid the need for hoses or other means to transport air between the pump 20 and the air chambers 12, 14, 16. In such embodiments, air passages comprising hoses, conduits incorporated into the internal vinyl layers, or other means extend through the peripheral air chamber 16 to each of the other interior chambers. Alternatively, the pump 20 may be positioned externally to the boundaries of the air mattress.

It is preferred that the system include a manually operable control 26 operatively connected to the air pump 20 for controlling the operation of the air pump 20. Control 26 preferably has a first setting, which is initiated by pressing a switch 28 labeled "inflate", for operating the air pump 20 in a first direction for inflating the air chambers 12, 14, 16. The control 26 also preferably has a second setting, which is initiated by pressing a switch 30 labeled "deflate" for operating the air pump 20 in a second direction for deflating the air chambers 12, 14, 16. The control 26 also includes various pump control circuitry 32 responsive to the inflate 28 and deflate 30 switches for causing pump 20 to respond in the corresponding manner. It should be noted that the use of a reversible air pump allows the air chambers to be rapidly deflated when desired.

It is also preferred that control 26 includes a gauge 34 for measuring the air pressure supplied by the pump to the various air chambers, in particular, chambers 12 and 14. The gauge 34 has associated therewith a display 36 for displaying the measured pressure. It should be appreciated that the measured pressure may vary from chamber to chamber as desired by the user. In particular, the pressure in air chamber 12 and chamber 14 are intended to vary from one another depending upon the respective sleeper's desired level of firmness. The pressure for the various chambers may be measured sequentially as each chamber is inflated or, alternatively, separate gauges may be associated with each chamber to simultaneously measure the pressure in each chamber. The display, in this latter case, may display the measured pressures sequentially, or a larger display may be used to display all pressures simultaneously. Control 26 preferably includes a memory 38 for recording the desired pressures in each air chamber, so that the user may conveniently reinflate the chambers to the desired pressures time after time.

Figure 3A:
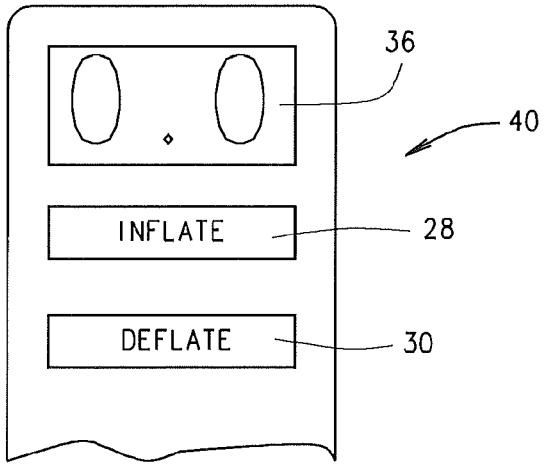
FIG. 3A is a front elevation of a portion of a control for the system of FIG. 1.

It is preferred that the control 26 include a handheld portion 40 (FIG. 3A) on which is disposed display 36 and the inflate 28 and deflate 30 switches. This makes inflation and deflation of the air chambers to the desired pressures extremely convenient for the user. The deflate modes of the control 26 for each air chamber allow for a slight delay after opening valves controlling the passage into and out of each chamber to allow the air to exit the chamber naturally and adjust the pressure before the pump 20 is actually engaged to vacuum the air out of the chamber. This will allow for a more precise adjustment to the ideal support for the user. Alternatively, the display and control switches may be disposed at the pump or in some other convenient location.

The arrangement of the air chambers 12, 14, 16 as illustrated in the embodiment of FIGS. 1 and 2 is now described in more detail. Air chambers 12, 14 are advantageously arranged adjacent to one another in a side by side arrangement with each air chamber 12, 14 oriented with its long axis parallel to the long axis of the air mattress 10. This arrangement allows two users of the mattress to each lie on their own respective air chamber that may be controlled independently of the other air chamber. This allows each user to inflate their air chamber with an individually tailored amount of air pressure so that the chamber has a desired level of firmness to produce optimum comfort for that user. With this side by side arrangement, two people can utilize the same mattress with each person being able to optimize their respective inflation level.

In an alternate embodiment, each air chamber 12, 14 may comprise multiple chambers to provide separately adjustable zones for each user. Air mattresses incorporating multiple adjustable zones are disclosed in U.S. Pat. No. 6,253,401, the disclosure of which is expressly incorporated by reference herein in its entirety.

Air chamber 16 represents a peripheral air chamber that extends around the entire perimeter formed by air chambers 12, 14. The peripheral air chamber 16 provides additional support to the perimeter of the mattress to prevent sagging of the mattress at its edge, which can make it more difficult for users to get on and off of a mattress. The relative narrowness of the peripheral air chamber 16 minimizes the movement of air away from the edge of the mattress, thereby retaining increased structural reinforcement of the mattress edge and minimizing collapsing of the edge. Inflation and deflation of the peripheral air chamber 16 may also be controlled independently of the contiguous side-by-side chambers 12, 14 but is not necessary for effective functioning of the mattress.

In some embodiments, an additional inflatable air chamber 50 is disposed below the air chambers 12, 14, 16 to form a foundation for the air mattress 10. As with air chambers 12, 14, 16 the lower air chamber 50 may include its own valve 18. Alternately, the foundation chamber 50 may connected with one of the air chambers 12, 14, 16, lying above the foundation chamber 50, which results in the foundation chamber 50 being filled simultaneously with and to the same pressure as such connected air chamber. In the embodiment of FIG. 1, the foundation air chamber 50 extends the entire length of the air mattress.

The internal structure of an embodiment of the present air mattress system is illustrated in FIG. 2. As can be readily seen, each air chamber 12, 14, 16 is formed with its own set of independent walls 60 that are distinct from the walls of the adjacent chamber. This internal structure provides increased structural integrity and durability for the air mattress.

Figure 4:
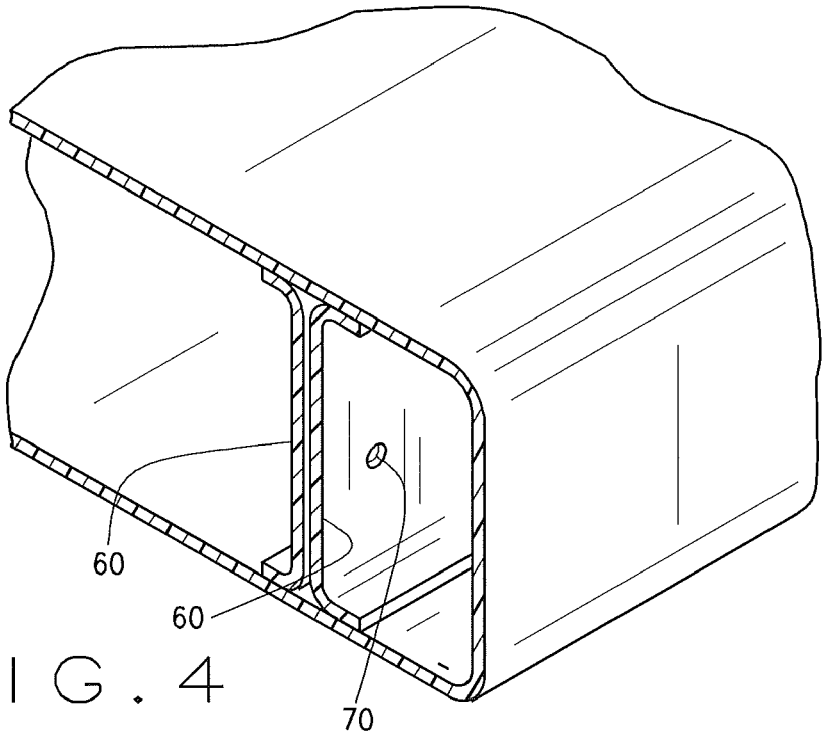
FIG. 4 is an enlarged cutaway view of an air mattress according to another embodiment of the present invention.
Figure 5:
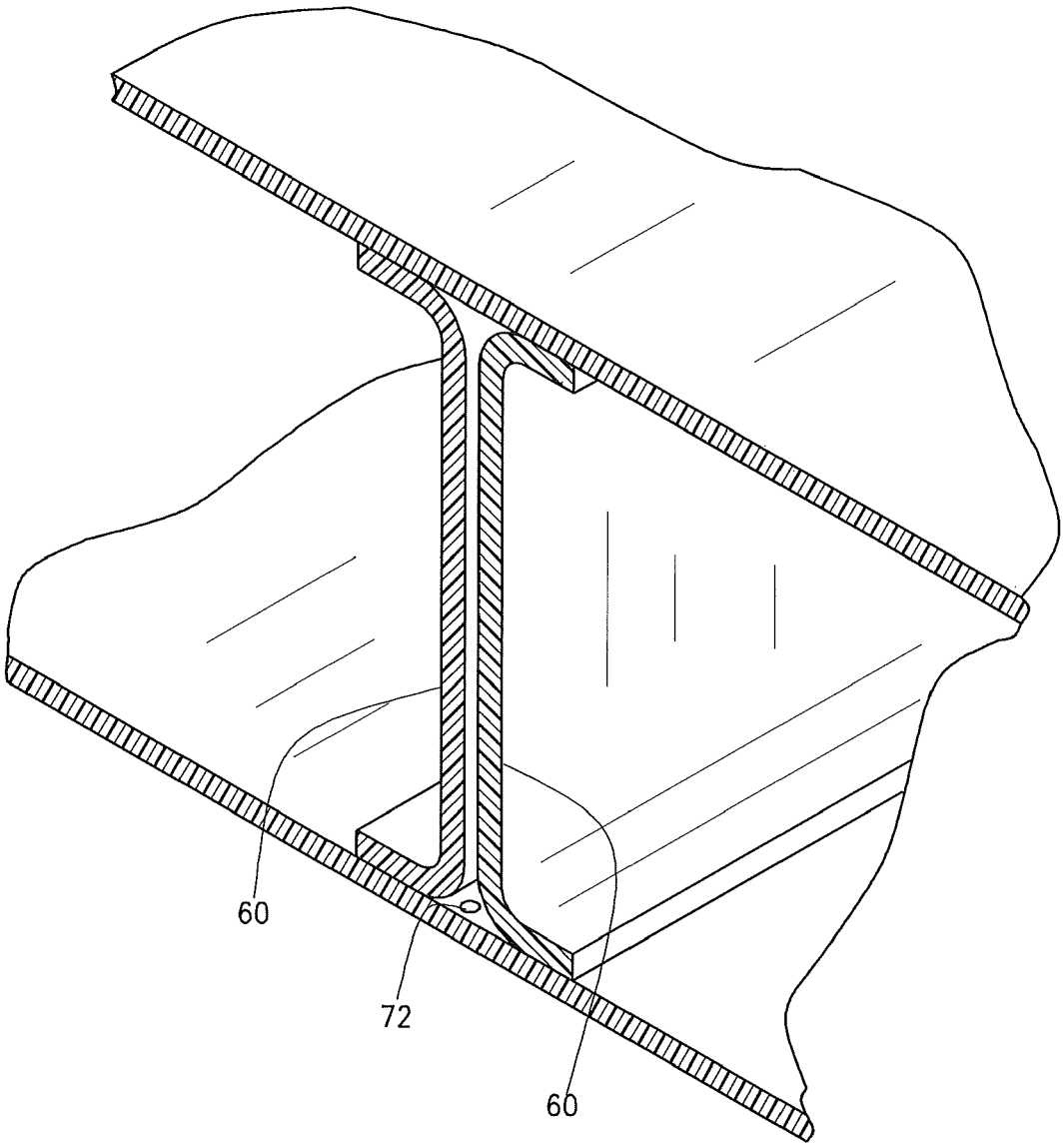
FIG. 5 is enlarged cutaway view of an alternate embodiment to the air mattress of FIG. 4.

However, in practice, the manufacture of an air mattress in this fashion raises significant challenges. In particular, as a natural part of the manufacturing process, air is generally trapped between the respective walls 60 of the individual air chambers 12, 14, 16. This trapped air makes it essentially impossible to completely evacuate all air from the mattress in order to fold it into the smallest possible size, which is a significant issue for the manufacturer in the context of initial packaging of the mattress as well as for the user in storing the air mattress when not in use. FIGS. 4 and 5 illustrate two alternate embodiments for addressing this issue. In the embodiment of FIG. 4, an outlet or port 70 is provided that allows air to pass from the space between the walls of air chambers 12, 14, 16 into the peripheral air chamber 16 where it can be fully evacuated through the valve in the air chamber 16. In the embodiment of FIG. 5, a port 72 is provided that allows air to pass from the space between the walls of air chambers 12, 14, 16 to atmosphere. In this embodiment, the port 72 may more particularly take the form of an eyelet hole with a grommet for reinforcement.

A fabric layer 80 may be laminated to the tops and sides of the air mattress 10. The fabric is preferably cotton, polyester, nylon, bamboo, or similar materials or combinations thereof. Lamination of the fabric layer 80 to the air mattress creates a secondary support system for the primary exterior vinyl layers 82 of the air mattress 10. This support can be further enhanced by extending the laminated fabric layer 80 to the bottom surface of the air mattress 10 as well. This additional support minimizes stretching of the vinyl that can occur when the air mattress 10 is inflated. This phenomenon is frequently referred to as "relaxation" of the vinyl. Relaxation in air mattresses can significantly impact user perception of air mattresses as the mattress appears to have lost air pressure after relaxation even though there are no actual leaks in the mattress. This is due to the fact that the total potential volume of the mattress has increased slightly relative to the volume of air contained within the mattress. The addition of the fabric layer 80 has the additional benefit of rendering the air mattress more puncture resistant.

The embodiment of FIGS. 1 and 2 also illustrates a portion of a cover 90 which in use covers the entire air mattress/foundation system. The cover 90 is optional, but when used can be quilted or non-quilted. It may be cotton, knit, or damask ticking with comfort layers of natural fibers, polyurethane foam, polyester fibers, or latex foam, if desired. Cover 90 may also have an indexed zipper to permit removal of the cover for washing, dry cleaning or replacement. Any of the embodiments may be used with or without a cover as desired.

In other embodiments of the air mattress system a comfort layer is incorporated into the air mattress between the cover 90 and the air chambers 12, 14, 16 to add additional plushness to the mattress. This comfort layer may consist of gel, foam, fiber or other cushioning material.

It should be appreciated that an air mattress of the present invention has numerous advantages over prior art systems. For example, due to its increased structural integrity and durability, the mattress provides a superior feel and performance more similar to much more expensive mattresses that incorporate solid material, e.g. foam, around their perimeters than to prior art air mattresses. However, the air mattresses described herein retain the benefit of being to be fully deflated for easy shipping and storage. It should be appreciated that the air mattress of the present invention is of a size when not inflated that it can be easily shipped for common freight carriers such as UPS and is in fact small enough to be placed on the shelf at commercial discount stores. In addition, certain embodiments may also offer a simplified set up option to enable a user to press a single button on a control to inflate all chambers simultaneously. Furthermore, by using a peripheral air chamber rather than the typical foam perimeter, the mattress comprises fewer components, which makes these mattresses easier and more intuitive to assemble and less expensive to produce.

The preferred embodiments of the invention have been described above to explain the principles of the invention and its practical application to thereby enable others skilled in the art to utilize the invention in the best mode known to the inventors. However, as various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by the above-described exemplary embodiments, but should be defined only in accordance with the following claims appended hereto and their equivalents.

What is claimed is:

1. An air mattress system comprising:

first and second contiguous inflatable air chambers operatively connected to form an air mattress having a length and a width, wherein a long axis of each contiguous air chamber is parallel to a long axis of said air mattress, said first and second contiguous inflatable air chambers together having a perimeter and each air chamber comprising a standard valve for permitting separate inflation and deflation of each air chamber;

a peripheral air chamber operatively connected to and arranged around said perimeter of said first and second contiguous inflatable air chambers and having a standard valve to permit inflation and deflation of said peripheral air chamber;

an air pump operatively connected with each said air chamber through each standard valve;

a control operatively connected to said air pump for controlling operation of said air pump; and wherein said first and second contiguous inflatable air chambers and said peripheral air chamber are formed by laminating an outer layer of nylon to an inner layer of vinyl.

2. The air mattress system as set forth in claim 1, further comprising at least one inflatable chamber disposed below at least one of said plurality of air chambers to form a foundation for said air mattress.

3. The air mattress system as set forth in claim 1, wherein said manually operable control comprises at least a first setting for operating said air pump in a first direction for inflating said air chambers and at least a second setting for operating said air pump in a second direction for deflating said air chambers.

4. The air mattress system as set forth in claim 1, further comprising a gauge for measuring air pressure in at least one of said air chambers, said gauge having a display for displaying said measured air pressure to a user.

5. The air mattress system as set forth in claim 1, further comprising a cover for covering said inflatable air chambers.

6. The air mattress system as set forth in claim 1, wherein said air pump is powered from a line power source.

7. The air mattress system as set forth in claim 1, wherein said manually operable control further includes a memory for storing at least one predetermined air chamber pressure setting.

8. The air mattress system as set forth in claim 1, wherein at least said first and second contiguous inflatable air chambers are separately inflatable to different pressures.

9. The air mattress as set forth in claim 1, wherein said peripheral air chamber is separately inflatable from said first and second contiguous inflatable air chambers.

10. The air mattress system as set forth in claim 2, wherein said foundation air chamber substantially extends across the majority of said length and width of said air mattress.

11. The air mattress system as set forth in claim 1, wherein each of said first and second contiguous air chambers comprise wall members distinct from said other of said first or second contiguous air chambers.

12. The air mattress system as set forth in claim 11, wherein said peripheral air chamber comprises wall members distinct from each of said first and second contiguous air chambers.

13. The air mattress system as set forth in claim 11, wherein said respective wall members of said first and second contiguous air chambers define a cavity between at least a portion of said first and second contiguous air chambers, said cavity being atmospherically isolated from said first and second contiguous air chambers and said air pump, and further comprising an outlet for evacuation of air trapped within said cavity to the atmosphere surrounding said air mattress system without passing through either of said first or second contiguous air chamber.

14. The air mattress system as set forth in claim 13, wherein said outlet is in communication with the atmosphere surrounding said air mattress.

15. The air mattress system as set forth in claim 1, further comprising a fabric layer laminated to at least a top and side surfaces of said air mattress.

16. The air mattress system as set forth in claim 1, wherein said control comprises a handheld portion connected with and remotely positioned from said air pump.

17. An air mattress system comprising:

a plurality of contiguous inflatable air chambers operatively connected to form an air mattress having a length and a width, wherein a long axis of each contiguous air chamber is parallel to a long axis of said air mattress, said plurality of contiguous inflatable air chambers further having a perimeter;

a peripheral air chamber operatively connected to and arranged around said perimeter of said plurality of contiguous inflatable air chambers;

an air pump operatively connected with each of said air chambers;

a gauge for measuring air pressure in at least one of said air chambers, said gauge having a display for displaying said measured air pressure to a user; and wherein said plurality of contiguous inflatable air chambers and said peripheral air chamber are formed by laminating an outer layer of nylon to an inner layer of vinyl.

18. The air mattress system as set forth in claim 17, further comprising at least one inflatable chamber disposed below at least one of said plurality of air chambers to form a foundation for said air mattress.

19. The air mattress system as set forth in claim 17, wherein said air pump is battery operated.

20. The air mattress system as set forth in claim 17, further including a manually operable control for said air pump, said control further including a memory for storing at least one predetermined air chamber pressure setting.

21. The air mattress system as set forth in claim 17, further including a cover for covering said inflatable air chambers.

22. The air mattress system as set forth in claim 17, wherein at least a second of said air chambers is separately inflatable to a different pressure from said one measured air pressure.

23. The air mattress as set forth in claim 22, further including at least one additional gauge for measuring the air pressure in at least one said separately inflatable air chamber, said additional gauge having a display for displaying the separately inflatable air chamber's measured air pressure to a user.

24. The air mattress system as set forth in claim 18, wherein said foundation air chamber substantially extends across the majority of the width and length of said air mattress.

25. The air mattress system as set forth in claim 17, wherein each of said plurality of contiguous air chambers comprises wall members distinct from said the other contiguous air chambers.

26. The air mattress system as set forth in claim 25, wherein said peripheral air chamber comprises wall members distinct from each of said plurality of contiguous air chambers.

27. The air mattress system as set forth in claim 25, wherein said respective wall members of said plurality of contiguous air chambers define a cavity between at least a portion of said contiguous air chambers, said cavity being atmospherically isolated from said first and second contiguous air chambers and said air pump, and further comprising an outlet for evacuation of air trapped within said cavity to the atmosphere surrounding said air mattress system without passing through either of said first or second contiguous air chamber.

28. The air mattress system as set forth in claim 27, wherein said outlet is in communication with the atmosphere surround said air mattress.

29. The air mattress system as set forth in claim 17, further comprising a fabric layer laminated to at least a top and side surfaces of said air mattress.

* * * * *